US006220997B1

(12) United States Patent
Kohl

(10) Patent No.: US 6,220,997 B1
(45) Date of Patent: Apr. 24, 2001

(54) EXERCISE EQUIPMENT PROPHYLACTIC COVERING SYSTEM

(76) Inventor: David Kohl, 11693 San Vicente Blvd., suite 804, Los Angeles, CA (US) 90049

( * ) Notice: Subject to any disclaimer, the term of this patent is extended or adjusted under 35 U.S.C. 154(b) by 0 days.

(21) Appl. No.: 09/494,984

(22) Filed: Jan. 31, 2000

Related U.S. Application Data

(60) Provisional application No. 60/147,384, filed on Aug. 3, 1999.

(51) Int. Cl.[7] ..... A63B 22/14
(52) U.S. Cl. ..... 482/148; 128/842
(58) Field of Search ..... 482/148; 297/228.1; 128/842, 844, 918

(56) References Cited

U.S. PATENT DOCUMENTS 5,294,127 * 3/1994 Keelan ..... 482/148
5,417,635 * 5/1995 Sell ..... 482/148
5,803,539 * 9/1998 Dewar ..... 297/228.12
5,866,925 * 9/1998 Hanley ..... 297/229
5,957,528 * 9/1999 Campbell ..... 297/228.1
6,079,779 * 6/2000 Tanaka ..... 297/228.1

* cited by examiner

*Primary Examiner*—Michael A. Brown
(74) *Attorney, Agent, or Firm*—Goldstein & Canino

(57) ABSTRACT

An exercise equipment prophylactic covering system, for use in preventing bodily contact with exercise equipment, and thereby preventing contact with bodily fluids from previous users of said exercise equipment. The system includes a seat cover, a single open ended tubular cover, a double open ended tubular cover, and a bicycle handle bar cover. The seat cover is preferably used on any type of seat, said cover attaching over the top of the seat back. The double open ended tubular cover is preferably used on any bar which does not have an open end or forms a continuous part of an exercise machine, such as the handle bars on step machines and the like. The single open ended tubular cover is preferably used on any equipment which provides an open ended handgrip, such as a pull down bar, dumbbells, barbells, and the like. The bicycle handle bar cover secures over the handle bars of a spinning bicycle.

5 Claims, 5 Drawing Sheets

EXERCISE EQUIPMENT PROPHYLACTIC COVERING SYSTEM

CROSS REFERENCES AND RELATED SUBJECT MATTER

This application is related to subject matter contained in provisional patent application Ser. No. 60/147,384, filed in the United States Patent Office on Aug. 3, 1999.

BACKGROUND OF THE INVENTION

The invention relates to exercise equipment protective coverings. More particularly, the invention relates to items for selectively covering exercise equipment prior to and during use, to prevent contact by the user with bodily fluids from others which may be present on the surfaces of the exercise equipment.

In crowded gyms, one user might begin to use a piece of exercise equipment a mere few minutes or even seconds after a previous user completed use thereof. With such a short time interval between users, a great possibility exists for disease transmission. A large variety of pathogens are present within bodily fluids. Since exercise often involves the secretion of sweat, expectoration of respiratory fluids through the mouth, and causes mucous to loosen and run from nasal passages, this mix of bodily fluids often ends up on the exercise equipment and can carry and transmit pathogens to an unsuspecting subsequent user.

In addition to the real possibility of disease transmission, most people simply find it unpleasant to sit, lay, or grasp exercise equipment which is coated in sweat from another person. For these reasons, many gyms at least attempt to require that each person wipe down the equipment after they user it.

While these units may be suitable for the particular purpose employed, or for general use, they would not be as suitable for the purposes of the present invention as disclosed hereafter.

SUMMARY OF THE INVENTION

It is an object of the invention to produce a protective system which prevents transmission of diseases between people who use the same piece of exercise equipment.

It is another object of the invention to produce protective devices which install on gym equipment, to prevent direct contact between the user and the machine.

It is a further object of the invention to produce protective devices which are suited for covering and protecting different types of exercise equipment. Accordingly, separate protective devices are available to protect hand grips, hand rails, and seats of commonly used exercise equipment.

It is a still further object of the invention to produce a protective device which is absorbent, so as to absorb sweat from the user, and provide a dry, comfortable, and soft feel.

The invention is an exercise equipment prophylactic covering system, for use in preventing bodily contact with exercise equipment, and thereby preventing contact with bodily fluids from previous users of said exercise equipment. The system includes a seat cover, a single open ended tubular cover, a double open ended tubular cover, and a bicycle handle bar cover. The seat cover is preferably used on any type of seat, said cover attaching over the top of the seat back. The double open ended tubular cover is preferably used on any bar which does not have an open end or forms a continuous part of an exercise machine, such as the handle bars on step machines and the like. The single open ended tubular cover is preferably used on any equipment which provides an open ended handgrip, such as a pull down bar, dumbbells, barbells, and the like. The bicycle handle bar cover is designed to completely cover the handle bars of an exercise bicyle, and is best suited for a so-called "spinning bicyle".

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
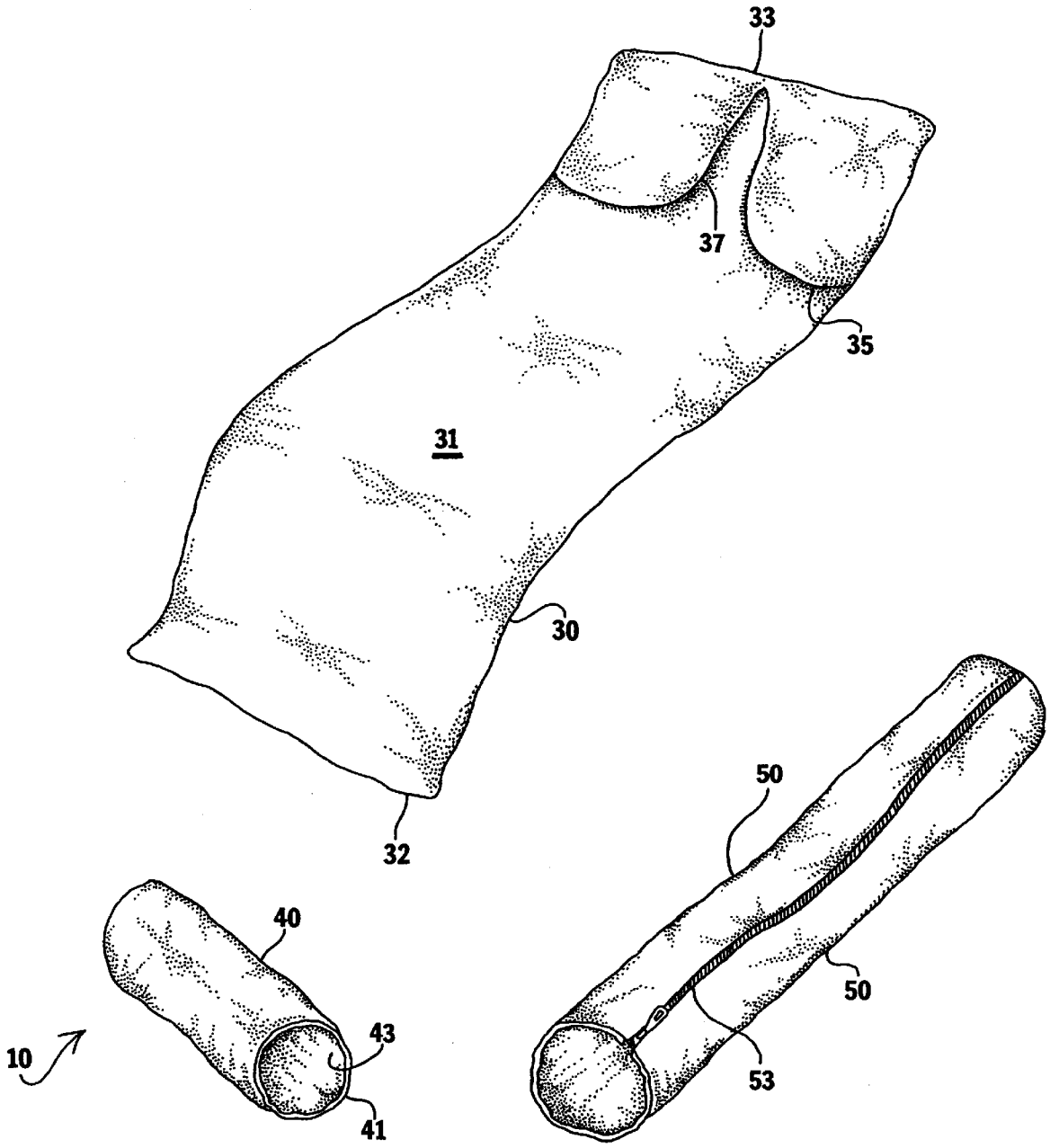
FIG. 1 is a diagrammatic perspective view, illustrating various components of the exercise equipment prophylactic covering system.
Figure 5:
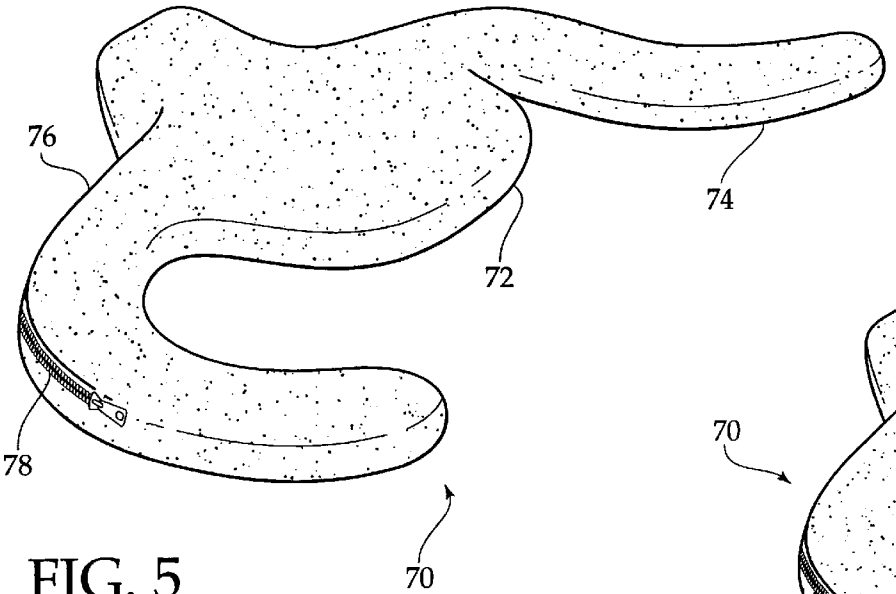
FIG. 5 illustrates a bicycle handle bar cover according to the present invention.

FIG. 1 illustrates an exercise equipment prophylactic covering system 10, which may include a seat cover 30, and tubular covers which include a single open ended tubular cover 40 and a double open ended tubular cover 50. A bicylce handle bar cover 70 is illustrated in FIG. 5.

The seat cover 30 has a back surface 31, having a bottom end 32 and a top end 33. The top end 33 has a pocket 35 formed at the top end 33, which preferably has a bisecting split 37, forming a upside down "V" at the top end 33. The function of this pocket 35 will be described hereinafter.

The single open ended tubular cover 40 is substantially the shape of a cylinder, having a single open end 41, and a bore 43 extending virtually the full length thereof.

The double open ended tubular cover 50 is substantially tubular in shape, having two open ends 51, wherein said tube is joined lengthwise by a longitudinal zipper 53 extending between the two open ends 51. The longitudinal zipper 53 essentially allows the double open ended tubular cover 50 to be un-zipped, and opened into a rectangular sheet. The cover 50 may then be wrapped around a bar, cylinder or tube, and then fastened around the bar, cylinder, or tube using the longitudinal zipper 53.

Figure 2:
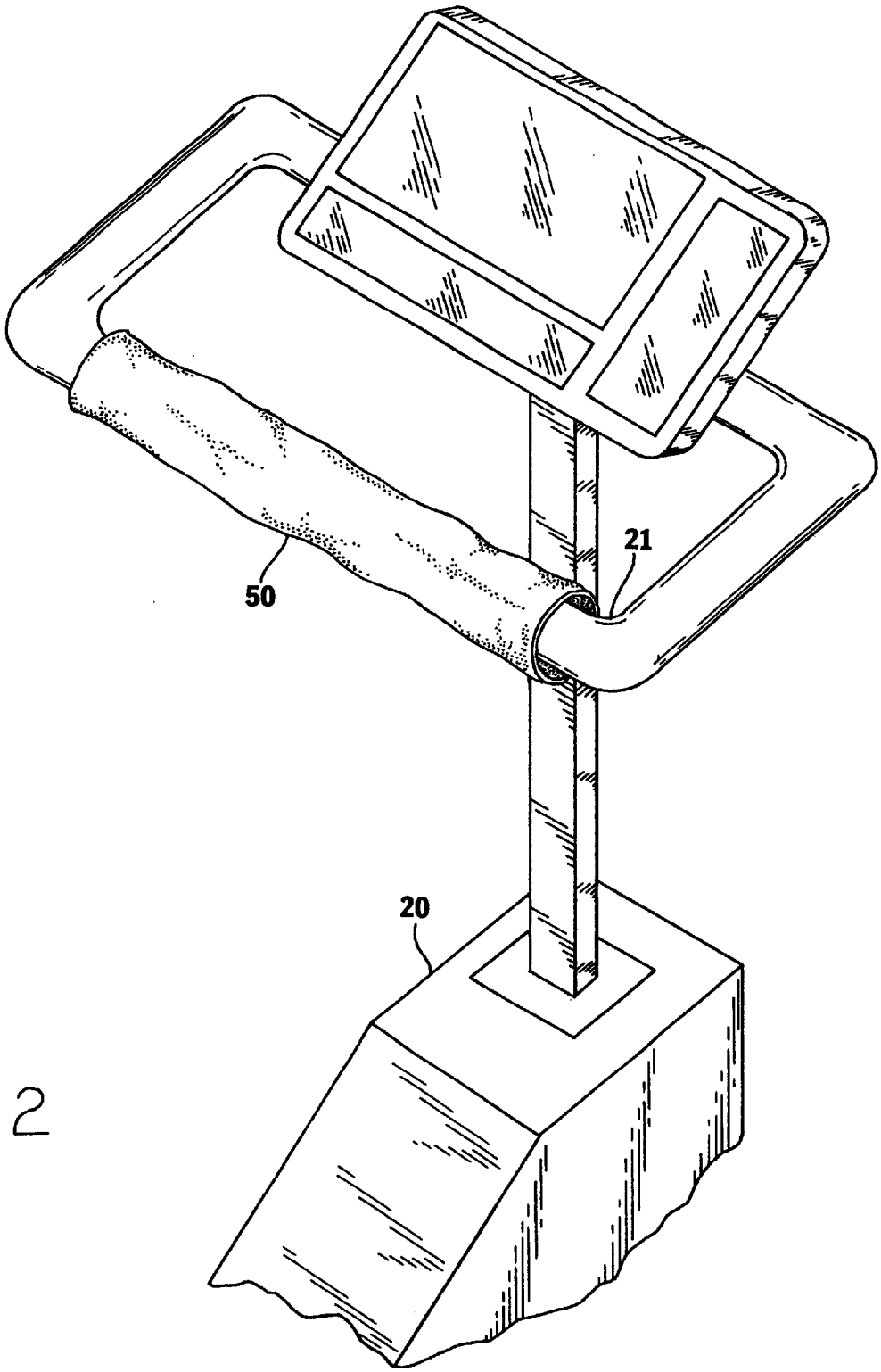
FIG. 2 illustrates a double open ended tubular cover according to the present invention being used on a piece of exercise equipment having an elongated handle bar.

FIG. 2 illustrates the double open ended tubular cover 50 in use on an exercise machine 20. The exercise machine illustrated is a "step" machine. The step machine has a horizontal bar 21 which the user holds on to as the machine is used. The horizontal bar 21 is not open, but forms a continuous loop with other portions of said machine. Therefore, according to the present invention, the horizontal bar 21 is covered with the double open ended tubular cover 50, since said double open ended tubular cover 50 can be opened, extended around the horizontal bar 21, and then secured thereon using the longitudinal zipper thereof.

Figure 3:
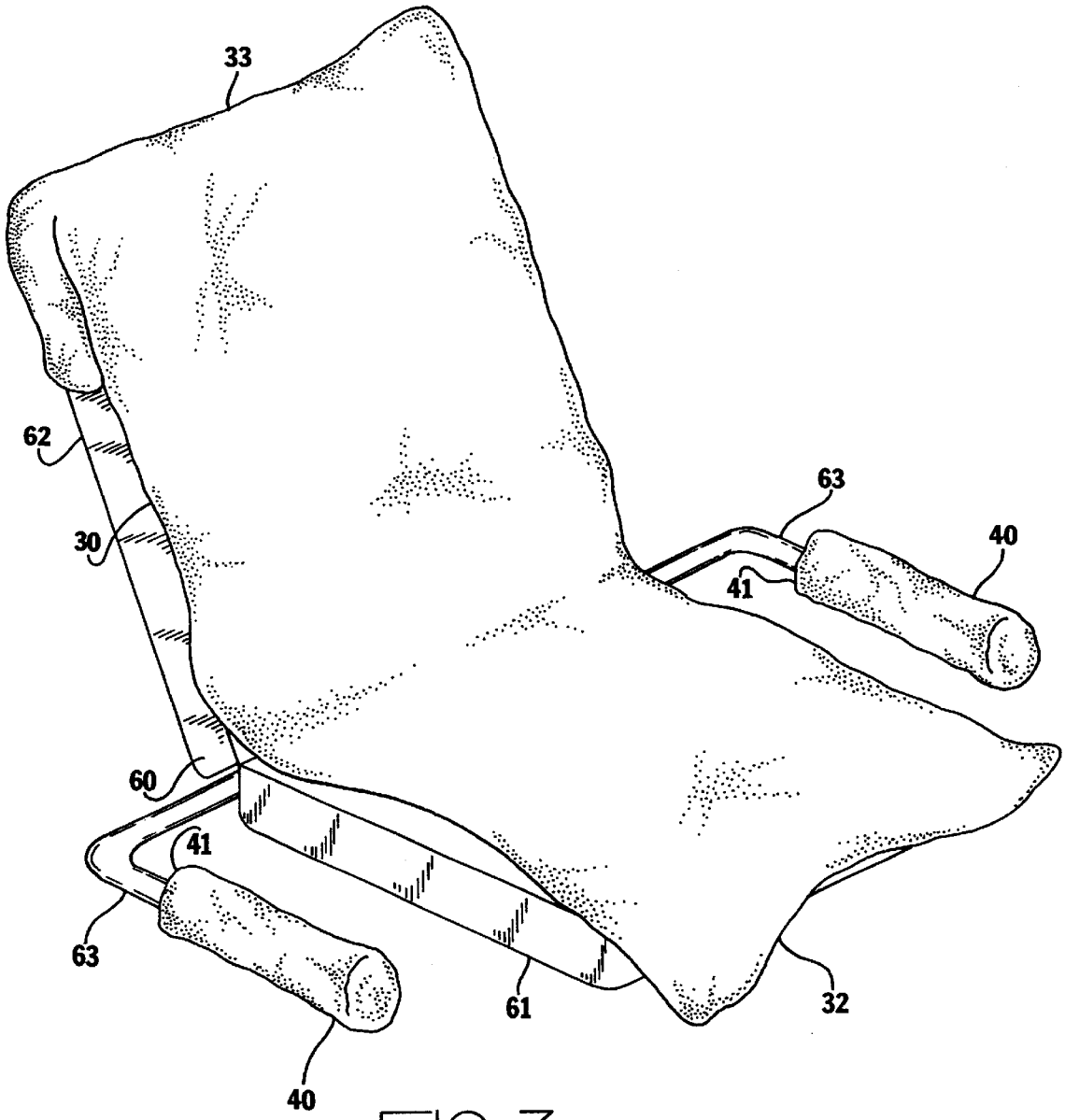
FIG. 3 illustrates a seat cover and a single open ended tubular cover according to the present invention being used on a piece of exercise equipment which has a seat and a pair of hand grips.
Figure 4:
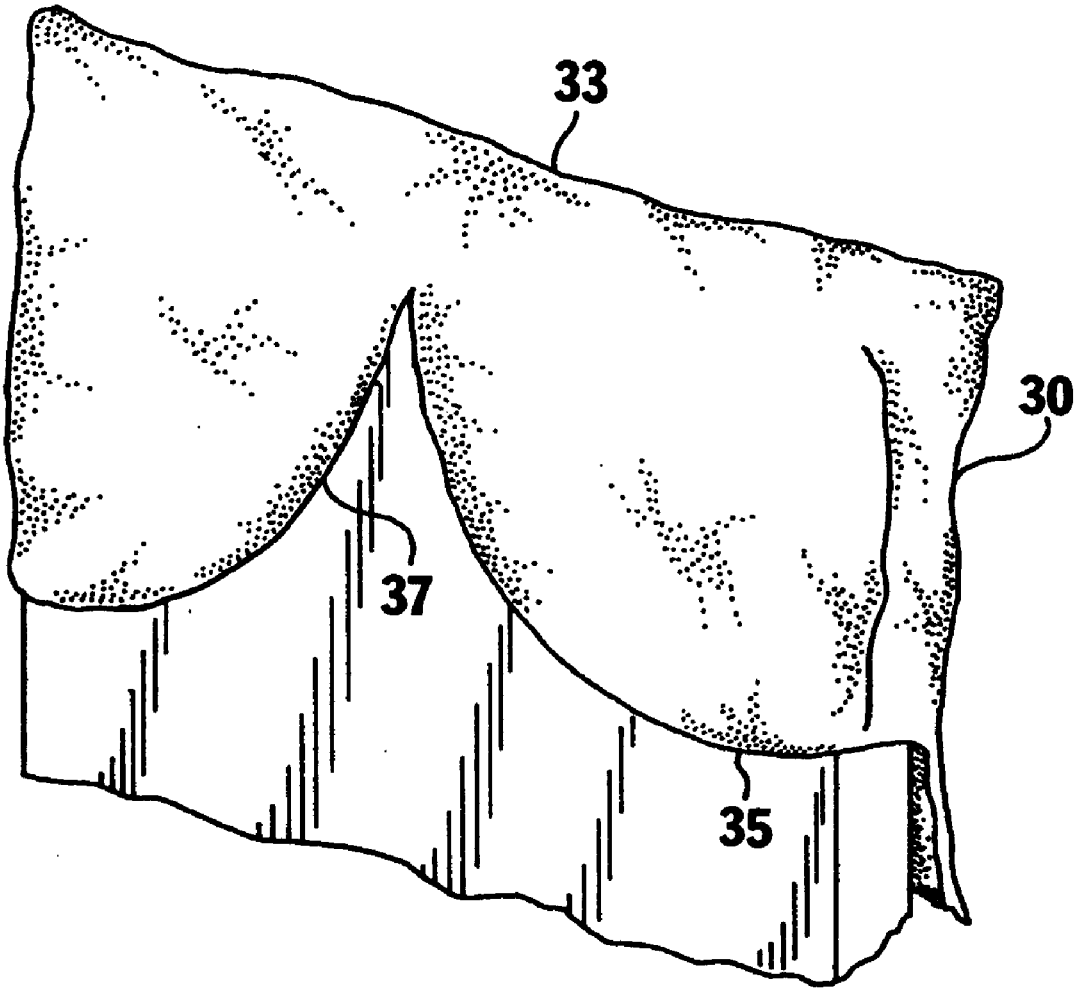
FIG. 4 illustrates the attachment of the seat cover onto the seat back on the seat of a piece of exercise equipment.

FIG. 3 illustrates the seat cover 30 and a pair of single open ended covers 40 being used on a piece of exercise equipment 60 having a seat bottom 61, a seat back 62, and a pair of handgrips 63. First, one of the single open ended covers 40 is extended over each of the handgrips 63, with the handgrips 63 inserted into the open ends 41 of each of said single open ended covers 40. Second, the seat cover 30 is extended over the seat back 62 with the top end 33 attached thereon, and the bottom end 32 draping over the seat bottom 61. Referring to FIG. 4, attachment of the seat cover 30 onto the seat back 62 is illustrated. The seat back 62 extends into the pocket 35, with the top end 33 of the cover 30 holding said cover 30 in place. The bisecting split 37 allows the cover 30 to adjust to different sized exercise equipment seats. The seat cover 30 can also be used on weight benches and many other similar exercise equipment configurations. The single open ended covers 40 can also be used on any type of handgrip, such as on pull-down bars, dumbbells, barbells, and the like.

Referring to FIG. 5, the bicycle handle bar cover 70 includes a central portion 72 and two arcuate extremities 74. the bicycle handle bar cover 70 has a posterior 76. A handle bar cover zipper 78 extends across the posterior 76 of the handle bar cover 70, extending between both arcuate extremities 74.

Figure 6:
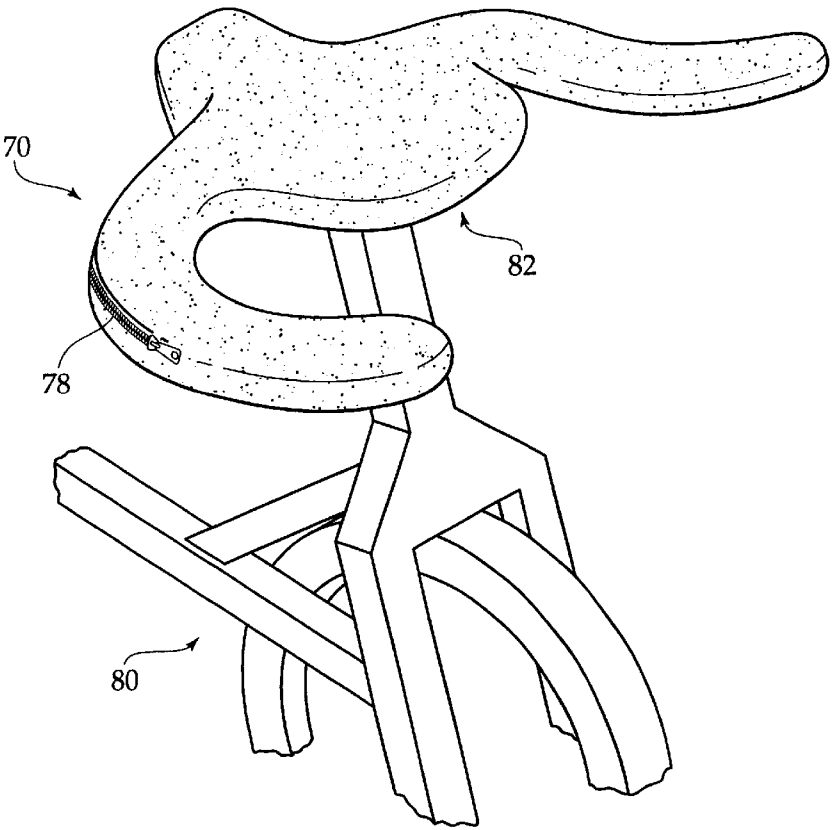
FIG. 6 illustrates the bicycle handle bar cover attached over the handle bars of a spinning bicycle.

Referring to FIG. 6, illustrated is an exercise bicycle 80, having a handle bar 82. The bicycle illustrated is a spinning bicycle, which has a distinctive handle bar 82 configuration having a pair of complementary arcuate handle portions. As illustrated in FIG. 6, the arcuate extremities 74 extend fully over the arcuate handle portions of the handle bar 82, and fits snuggly thereupon. The handle bar cover zipper 78 is closed to ensure that the bicycle handle bar cover 70 remains securely on the handle bar 82. Once securely on the handle bar 82, the bicycle 80 can be safely utilized.

Preferably all components of the covering system 10 are made of a soft, absorbent, towel or terry-cloth like material. However, it is contemplated that any material which provides the protective and comfort qualities according to the goals of the invention may be utilized.

In conclusion, herein is presented an exercise equipment prophylactic covering system, which prevents direct contact between an exercise equipment user and the exercise equipment itself. The system thereby prevents transmission of pathogens and even contact with bodily fluids from a previous user of the same exercise equipment.

In conclusion, herein is presented a system for effectively covering that portion of exercise equipment which comes into contact with the user in a multi-user exercise environment, such that the transmission of bodily fluids and germs through said equipment is eliminated or drastically reduced.

What is claimed is:

1. An exercise equipment covering method for use by a person when using a niece of exercise equipment having a handle bar, comprising the steps of:

providing a cover which is tubular, having two open ends and a longitudinal zipper extending between the two open ends, opening the longitudinal zipper to create a rectangular sheet of the cover;

wrapping the cover around handle bar;

closing the zipper to form the cover into a tube through which the handle bar extends;

using the exercise equipment by the person; and removing said cover by the person.

2. An exercise equipment covering method for use by a person when using a piece of exercise equipment having a seat having a seat back and seat bottom, comprising the steps of:

providing a cover comprising a seat cover having a top end and a bottom end, the top end having a pocket;

extending the seat back into the pocket of the seat cover;

draping the seat cover downward along the seat back;

using the exercise equipment by the person; and removing said cover by the person.

3. The exercise equipment covering method as recited in claim 2, wherein the step of draping the seat cover downward further comprises draping the bottom end of the seat cover over the seat bottom.

4. The exercise equipment covering method as recited in claim 3, wherein the pocket of the seat cover has a bisecting split for adjusting to different sized seat backs.

5. An exercise equipment covering method for use by a person when using a piece of exercise equipment having bicycle handle bars having two complementary arcuate handles, comprising the steps of:

providing a cover having two arcuate extremities sized to completely encase the bicycle handle bars, having a posterior, and having a handle bar cover zipper extending on the posterior between the arcuate extremities;

extending the arcuate extremities over the arcuate handles of the bicycle handle bars;

closing the zipper on the posterior of the cover to secure the cover on the handle bars;

using the exercise equipment by the person; and removing said cover by the person.

* * * * *